US010731660B2

(12) United States Patent
Nesteroff et al.

(10) Patent No.: US 10,731,660 B2
(45) Date of Patent: Aug. 4, 2020

(54) DIFFUSER HAVING PLATFORM VANES

(71) Applicant: Rolls-Royce Corporation, Indianapolis, IN (US)

(72) Inventors: Michael Nesteroff, Indianapolis, IN (US); Jonathan Acker, Westfield, IN (US); Albert Moncada, Brownsburg, IN (US); David Templin, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 98 days.

(21) Appl. No.: 16/104,671

(22) Filed: Aug. 17, 2018

(65) Prior Publication Data

US 2020/0056625 A1 Feb. 20, 2020

(51) Int. Cl.
*F04D 29/44* (2006.01)
*F01D 9/04* (2006.01)

(52) U.S. Cl.
CPC ..... *F04D 29/444* (2013.01); *F01D 9/041* (2013.01); *F01D 9/044* (2013.01); *F05D 2230/237* (2013.01); *F05D 2240/12* (2013.01)

(58) Field of Classification Search
CPC ..... F01D 9/041; F01D 9/044; F04D 29/444
See application file for complete search history.

(56) References Cited

U.S. PATENT DOCUMENTS 2,681,788 A * 6/1954 Wosika ..... F01D 9/044 415/137
4,344,737 A * 8/1982 Liu ..... F04D 29/441 415/199.1

(Continued)

FOREIGN PATENT DOCUMENTS

EP 1214172 B1 12/2003
FR 459801 A 11/1913

(Continued)

OTHER PUBLICATIONS

European Search Report for Application No. 19186724.1-1006 dated Feb. 1, 2020, 9 pages.

*Primary Examiner* — Ninh H. Nguyen
(74) *Attorney, Agent, or Firm* — Barnes & Thornburg LLP

(57) ABSTRACT

According to some aspects of the present disclosure, a diffuser for a centrifugal compressor is provided. The diffuser may comprise an outerband casing and an innerband casing. The outerband casing may comprise an annular flowpath boundary member that has a flowpath boundary surface. The flowpath boundary member may define a plurality of vane-receiving pockets spaced about a circumference of the member. The innerband casing may comprise an annular flowpath boundary member that has a flowpath boundary surface. The flowpath boundary member may comprise a plurality of vanes spaced about a circumference of the member. Each of said plurality of vanes may comprise a vane body that extends from the flowpath boundary surface, a platform head that has a lateral dimension normal to the length of the vane body greater than the lateral dimension of the vane body, and a fillet between the platform head and the vane body. The innerband casing may be positioned so that the platform head of each of the plurality of vanes is received in a respective vane-receiving pocket defined by the flowpath boundary member of the outerband casing. When received, the fillet of each of the plurality of vanes may be adjacent the flowpath boundary surface of the flowpath boundary member of said outerband casing. The flowpath boundary surfaces of each of said casings and said vanes define a fluid flowpath in said diffuser.

16 Claims, 5 Drawing Sheets

(56) References Cited

U.S. PATENT DOCUMENTS

| | | | | |
|---|---|---|---|---|
| 5,344,717 | A | 9/1994 | Dutton, Jr. et al. | |
| 6,280,139 | B1 | 8/2001 | Romani et al. | |
| 6,442,940 | B1 | 9/2002 | Young et al. | |
| 7,094,024 | B2 * | 8/2006 | Nguyen | F02C 7/04 29/888.02 |
| 7,955,051 | B2 * | 6/2011 | Daguenet | F01D 9/044 415/208.3 |
| 9,121,408 | B2 * | 9/2015 | Shioda | F04D 27/0246 |
| 9,289,826 | B2 | 3/2016 | Morris et al. | |
| 2005/0158173 | A1 | 7/2005 | Nguyen et al. | |
| 2011/0081240 | A1 * | 4/2011 | Durocher | F01D 9/044 415/209.3 |
| 2018/0135647 | A1 | 5/2018 | Okada et al. | |

FOREIGN PATENT DOCUMENTS

| | | | |
|---|---|---|---|
| JP | S56162298 | A | 12/1981 |
| JP | H08312590 | A | 11/1996 |
| WO | 2005035993 | A1 | 4/2005 |
| WO | 2013088078 | A1 | 6/2013 |
| WO | 2011152454 | A | 8/2013 |

* cited by examiner

DIFFUSER HAVING PLATFORM VANES

BACKGROUND

Centrifugal compressors are commonly used for fluid compression in rotating machines such as, for example, a gas turbine engine. Gas turbine engines typically include at least a compressor section, a combustor section, and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

A centrifugal compressor is a device in which a rotating rotor or impeller delivers air at relatively high velocity by the effect of centrifugal force on the gas within the impeller. A diffuser is commonly an annular space surrounding the periphery of the impeller and which usually is provided with vanes to guide the gas flow in order to recover static pressure and minimize turbulence and frictional losses in the diffuser. A diffuser is typically positioned downstream of the centrifugal compressor to de-swirl or align the air direction required for subsequent engine components. The air or other gas (which will be referred to hereafter as air) is delivered from the impeller with a velocity having a substantial radial component and, ordinarily, a substantially greater tangential component. The function of the diffuser is to decelerate the air smoothly and to recover as static pressure (head) the total or stagnation pressure (dynamic head) of the air due to its velocity.

SUMMARY

According to some aspects of the present disclosure, a diffuser for a centrifugal compressor is provided. The diffuser may comprise an outerband casing and an innerband casing. The outerband casing may comprise an annular flowpath boundary member that has a flowpath boundary surface. The flowpath boundary member may define a plurality of vane-receiving pockets spaced about a circumference of the member. The innerband casing may comprise an annular flowpath boundary member that has a flowpath boundary surface. The flowpath boundary member may comprise a plurality of vanes spaced about a circumference of the member. Each of said plurality of vanes may comprise a vane body that extends from the flowpath boundary surface, a platform head that has a lateral dimension normal to the length of the vane body greater than the lateral dimension of the vane body, and a fillet between the platform head and the vane body. The innerband casing may be positioned so that the platform head of each of the plurality of vanes is received in a respective vane-receiving pocket defined by the flowpath boundary member of the outerband casing. When received, the fillet of each of the plurality of vanes may be adjacent the flowpath boundary surface of the flowpath boundary member of said outerband casing. The flowpath boundary surfaces of each of said casings and said vanes define a fluid flowpath in said diffuser.

According to some aspects of the present disclosure, a diffuser for a centrifugal compressor is provided. The diffuser may comprise an outerband casing may comprise an annular flowpath boundary member having a flowpath boundary surface. The flowpath boundary member may define a plurality of vane-receiving pockets spaced about a circumference of the member. The innerband casing may comprise an annular flowpath boundary member having a flowpath boundary surface. The flowpath boundary member may comprise a plurality of vanes spaced about a circumference of the member, each of the plurality of vanes may comprise a vane body extending from the flowpath boundary surface, and a platform head that may have a lateral dimension normal to the length of the vane body greater than the lateral dimension of the vane body. The innerband casing may be positioned so that the platform head of each of the plurality of vanes is received in a respective vane-receiving pocket defined by the flowpath boundary member of the outerband casing. The innerband casing may be coupled to the outerband casing by a joint between the platform head of each of the plurality of vanes and the boundary member of said outerband casing. The flowpath boundary surfaces of each of said casings and said vanes define a fluid flowpath in said diffuser.

According to some aspects of the present disclosure, a method of diffusing an air flow is provided. The method may comprise forming a fluid flowpath and supplying air flow through the fluid flowpath. The fluid flowpath may be defined by a first annular surface, a second annular surface, and a plurality of vanes that may extend between the first and second annular surfaces. Each of the plurality of vanes may comprise a vane body extending from the first annular surface and a platform head that may have a lateral dimension normal to the length of the vane body greater than the lateral dimension of the vane body. Each platform head may be positioned in a pocket defined by the second annular surface and joined to the second annular surface.

BRIEF DESCRIPTION OF THE DRAWINGS

The following will be apparent from elements of the figures, which are provided for illustrative purposes.

Figure 1:
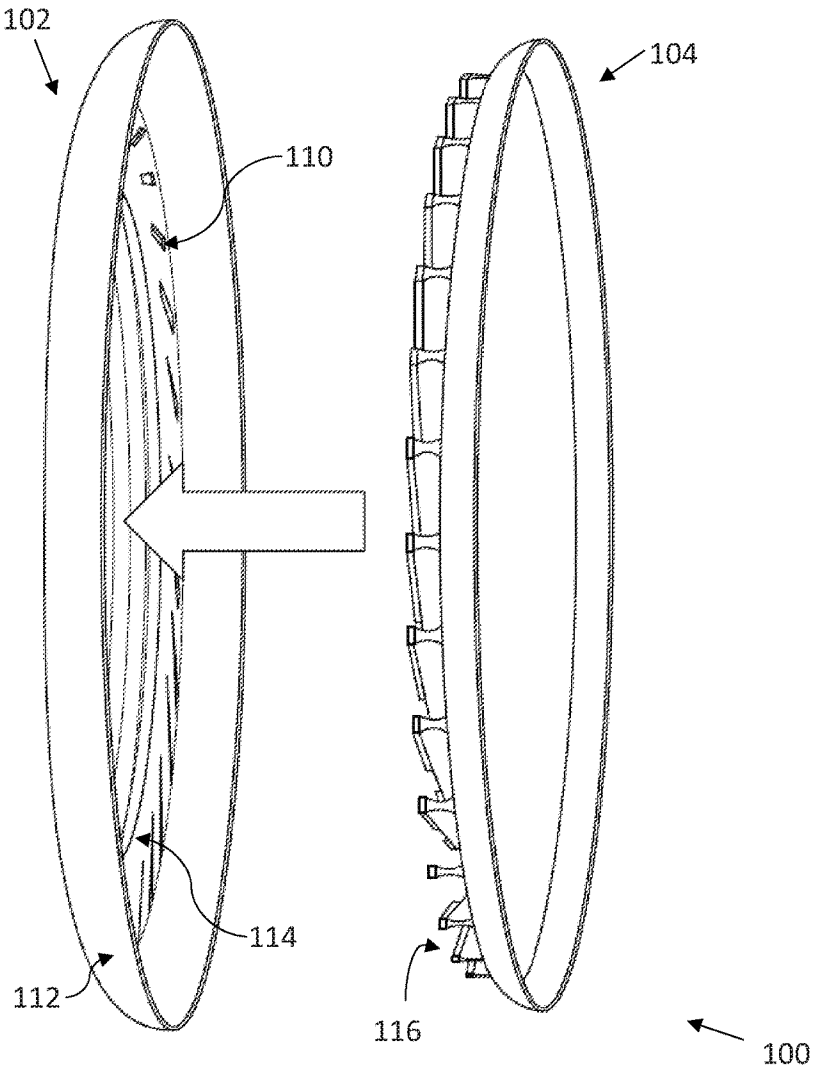
FIG. 1 is an exploded side view of several component parts of a diffuser in accordance with some embodiments of the present disclosure.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments in the drawings and specific language will be used to describe the same.

The present disclosure is directed to an improved diffuser for a centrifugal compressor. In centrifugal-compressor diffusers having a plurality of vanes extending between a pair of annular casings, unacceptable levels of material stress were observed in vane-to-casing joints at the vane tip (i.e. the upstream end of the vane). The present disclosure alleviates these unacceptable stresses by moving the vane-to-casing joint away from the vane tip. Specifically, each of the plurality of vanes according to the present disclosure comprise a vane body and a platform head. The platform head is wider in a lateral dimension than the vane body, such that the coupling of the platform head and an annular casing is made by a joint moved more distant from the vane tip. Additionally, a fillet can be inserted between the platform head and vane body to further reduce stress. In designs in which the joint between vane body and the annular casing is adjacent to the vane body, adding a fillet after joining of the two is more difficult and can be less reliably accomplished.

FIG. 1 depicts an exploded, side view of several component parts of a diffuser 100 in accordance with some embodiments of the present disclosure. The diffuser 100 may be located downstream of a centrifugal compressor (not shown) and is designed to recover pressure from and de-swirl the high velocity air exiting the compressor. The diffuser 100 may comprise an outerband casing 102 and an innerband casing 104. Both of these components share a common axis with each other and the centrifugal compressor. The outerband casing 102 comprises pockets 110, annular flowpath boundary member 112, and flowpath boundary surface 114. The innerband casing 104 comprises vanes 116.

Figure 2:
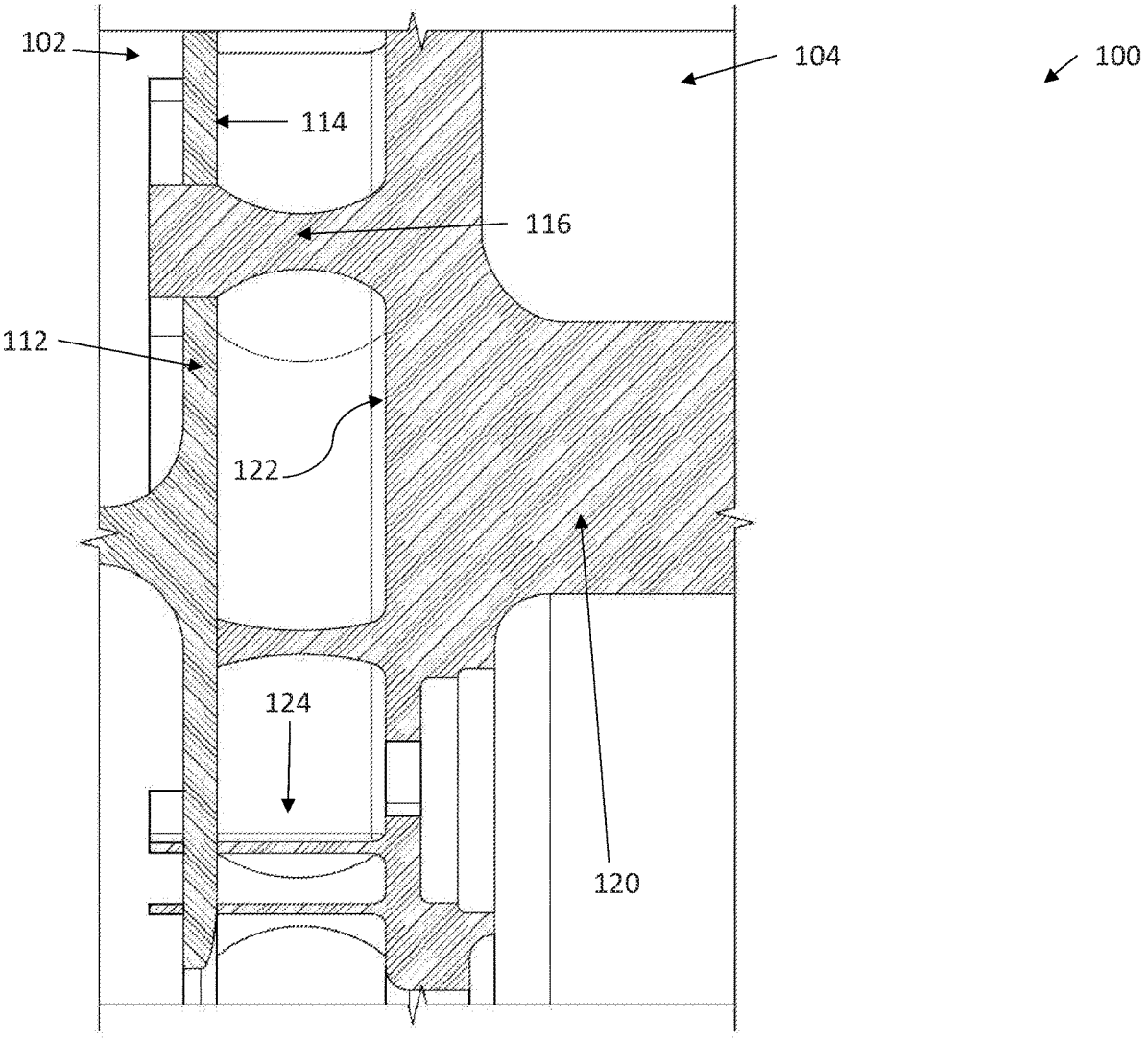
FIG. 2 is an axial cutaway view of a diffuser in accordance with some embodiments of the present disclosure.

FIG. 2 illustrates an axial cutaway view of an assembled diffuser 100 in accordance with some embodiments of the present disclosure. The diffuser 100 may comprise an outerband casing 102 and an innerband casing 104. Innerband casing 104 comprises innerband flowpath boundary member 120 and innerband flowpath boundary surface 122 in addition to vanes 116. Together, the outerband flowpath boundary surface 114, the innerband flowpath boundary surface 122, and vanes 116 form fluid flowpath 124 that directs air through the diffuser 100 to reduce recover static pressure and de-swirl air flow. As shown in FIG. 2, air flows downward between the innerband casing 104, outerband casing 102, and vanes 116.

Figure 3:
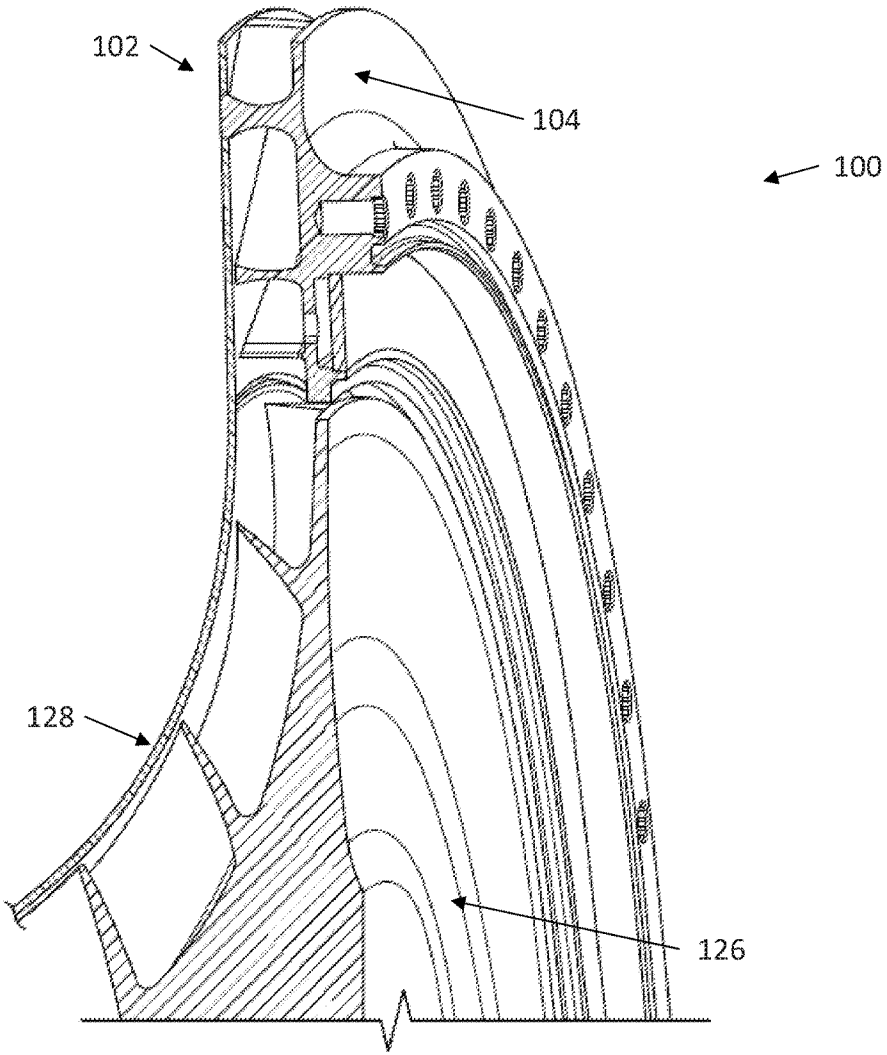
FIG. 3 is a perspective cutaway view a diffuser and centrifugal compressor in accordance with some embodiments of the present disclosure.

The spatial relationship of the diffuser 100 to other components in the centrifugal compressor is shown in FIG. 3. The diffuser 100 (shown with outerband casing 102 and innerband casing 104), is placed generally radially outward of centrifugal pump impeller 126 and impeller shroud 128. The outerband casing 102 is mounted to static component/casing (not shown) of the centrifugal compressor to maintain diffuser 100 in position around the impeller 126.

Figure 4:
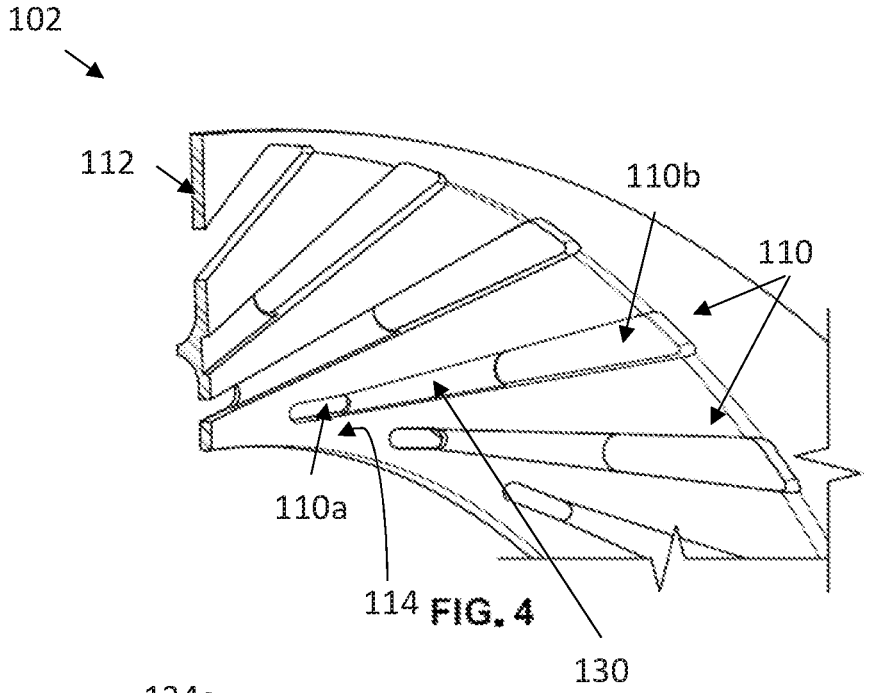
FIG. 4 is a perspective cutaway view of an outerband casing of a diffuser in accordance with some embodiments of the present disclosure.

Turning to the outerband casing 102 in more detail, FIG. 4 illustrates a perspective cutaway view the outerband casing 102 in accordance with some embodiments of the present disclosure. The outerband casing 102 encloses the innerband casing 104 (not shown). The outerband casing 102 comprises pockets 110 and flowpath boundary member 112. The flowpath boundary member 112 has a surface, flowpath boundary surface 114, that faces toward the innerband casing 104 (not shown) and partially defines the fluid flowpath 124 shown in FIG. 2. The pockets 110 are apertures defined in the flowpath boundary member 112. Each pocket 110 is configured to receive a portion of the vane 116 of innerband casing 104. As shown in FIGS. 1 and 4, the pockets 110 are arranged around a circumference of the flowpath boundary member 112. A pocket 110 may be formed by a pair of spaced-apertures, a first aperture 110*a* and a second aperture 110*b*, such that the pair of apertures align with a single vane 116. A portion of the flowpath boundary surface 114 between the first and second apertures 110*a* and 110*b* may be removed, or recessed, to thereby define a groove 130 between the apertures. This groove 130 aids in the placements of the vane 116 into the pockets at the correct depth.

In accordance with some embodiments of the present disclosure, the pockets 110 of the outerband flowpath boundary member 112 are designed to carry the diffuser 100 loads transferred through the vanes 116. By inserting the vane 116, and more particularly the platform heads 134 (see FIGS. 5 and 6) of vanes 116, through the thickness of the outerband flowpath boundary member 112, the portions of the member 112 that define pockets 110 can provide a normal force to carry the load of the vanes 116. This design compares favorably to other designs in which vanes 116 were merely brazed to the outerband flowpath boundary surface 114. In these other designs, the braze alone is required to support these lateral loads from the vane.

Figure 5:
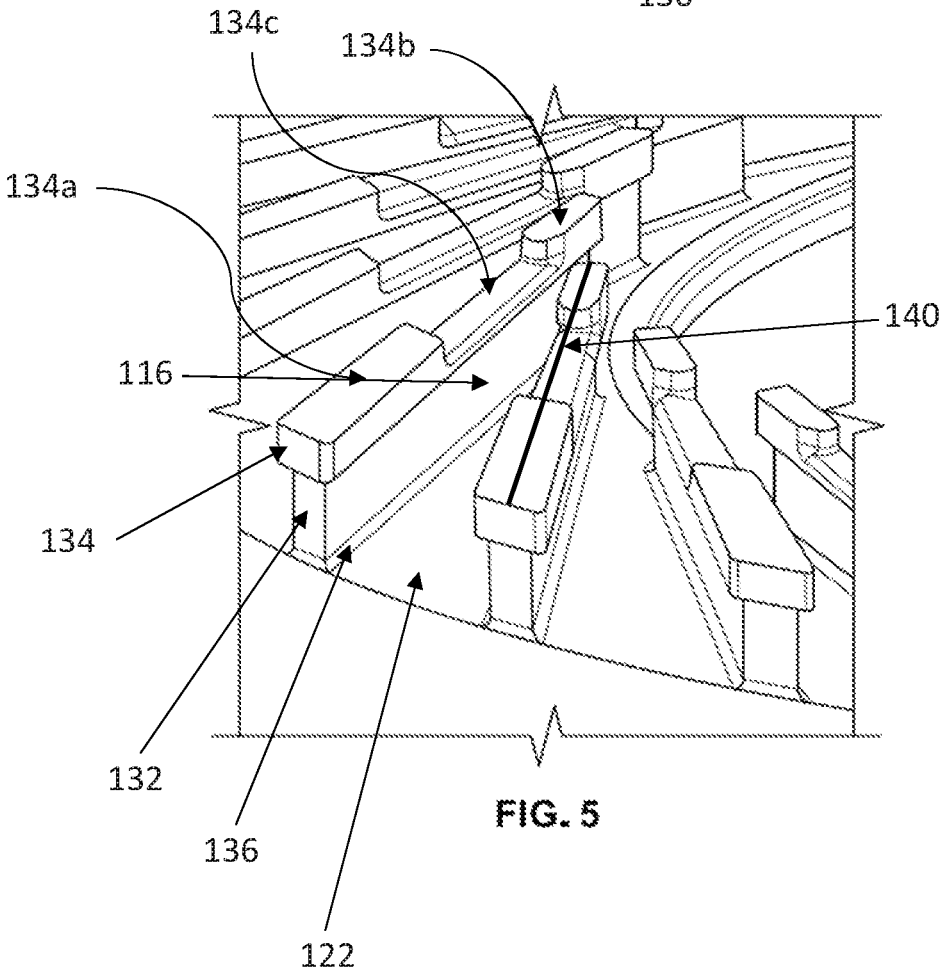
FIG. 5 is a perspective view of an innerband casing of a diffuser in accordance with some embodiments of the present disclosure.
Figure 6:
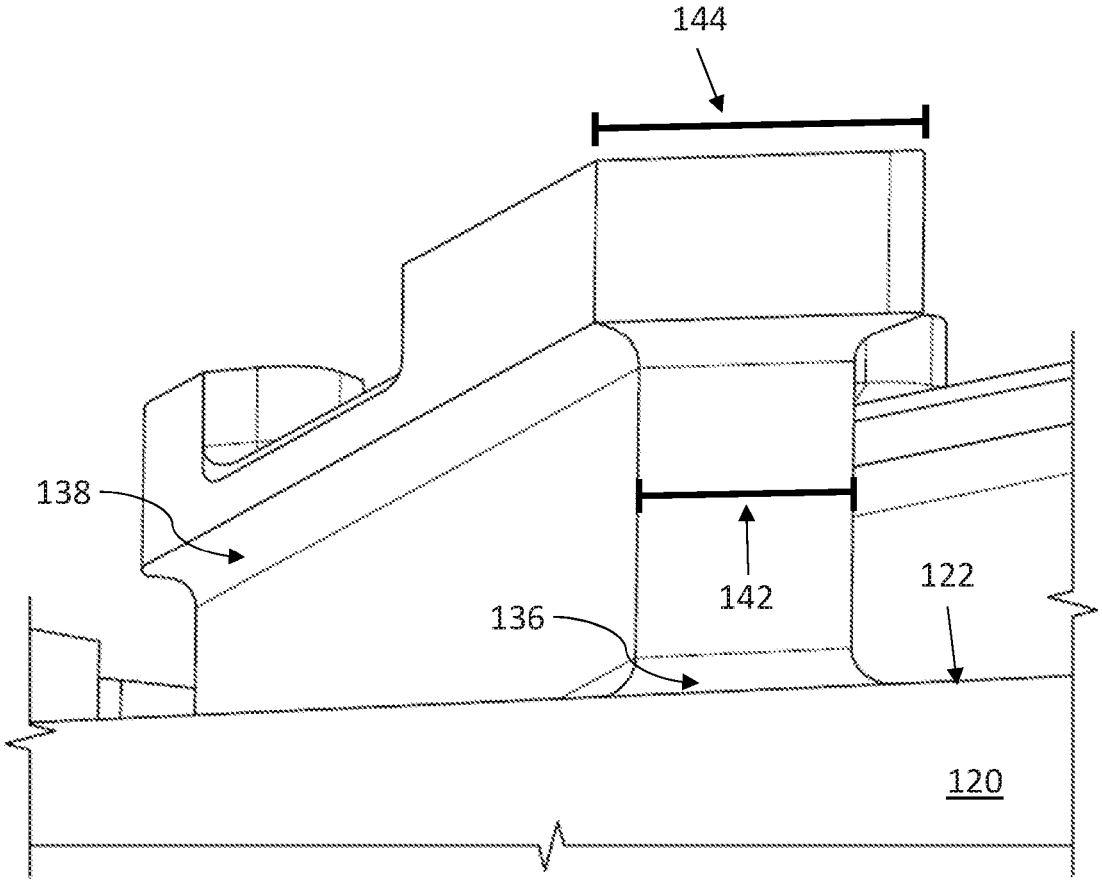
FIG. 6 is a perspective view of a vane of the innerband casing of a diffuser in accordance with some embodiments of the present disclosure.

In accordance with some embodiments of the present disclosure, the innerband flowpath boundary surface 122 and vanes 116 of the innerband casing 104 are shown in greater detail in the perspective views of FIG. 5 and FIG. 6. The innerband casing 104 may comprise an annular innerband flowpath boundary member 120 that may have an innerband flowpath boundary surface 122. The innerband flowpath boundary surface 122, together with the outerband flowpath boundary surface 114 (as seen in FIGS. 1 to 4) and vanes 116, defines the fluid flowpath 124 (see FIG. 2) through diffuser 100. The innerband flowpath boundary member 120 comprises a plurality of vanes 116 that are spaced about the circumference of the innerband flowpath boundary member 120 (see FIG. 1). Each vane 116 comprises a vane body 132 that extends from the innerband flowpath boundary surface 122 toward the outerband flowpath boundary surface 114, and a platform head 134. The vane may comprise a body 132 that extends from the innerband flowpath boundary surface 122 and terminates in a platform head 134. In some embodiments the vanes 116 may further comprise fillets 136 (between the vane body 132 and the innerband flowpath boundary surface 122), and fillet 138 (between the vane body 132 and the platform head 134), both of which reduce stress that may otherwise be found in the often ninety-degree interface between the vane 116 and the flowpath boundary surfaces and/or the platform head 134.

The platform head 134 of each vane is dimensioned together with an associated pocket 110 such that the platform head 134 is received within the pocket 110. For pockets 110 having a first and second aperture (for example, 110*a* and 110*b* as shown in FIG. 4), the associated vane 116 may have a first platform portion 134*a* and a second platform portion 134*b*, each being dimensioned to be positioned into the first pocket aperture 110*a* and the second pocket aperture 110*b*, respectively, of the pocket 110. Further, the platform head 134 may have a third platform portion 134*c* that may be configured to engage or interface with groove 130 (see FIG. 4) in the outerband flowpath boundary member 112. The first and second platform portions 134*a* and 134*b* may have height/thickness in a substantially axial dimension (The axial characterization of this dimension is made with reference to the common axis shown in FIG. 1. This dimension may also be considered to be normal to the innerband flowpath boundary surface 122, i.e., upward in FIG. 6) that is greater than the height of the third platform portion 134*c* in the same substantially axial dimension. This allows for the first and second platform portions 134*a* and 134*b* to be inserted into the first and second pocket apertures 110*a* and 110*b*, respectively. The first and second platform portions 134*a* and 134*b* may extend beyond the outerband flowpath boundary member 112 when inserted into the first and second pocket apertures 110*a* and 110*b*, respectively. The third platform portion 134*c* may have an axial height such that when it is engaged with the groove 130 there exists a smooth transition between the outerband flowpath boundary surface 114 and the vane 116. The first and second platform portions 134*a* and 134*b* may have different overall lengths from one another as measured along the length/mean camber line of the vane 116.

In some embodiments, the axial height of a portion of the platform head 134 is greater than the axial thickness of the outerband flowpath boundary member 112. This allows the platform head 134 to extend beyond, or protrude, past the outerband flowpath boundary member 112.

The joint between a vane and the outerband flowpath boundary member can affect the stress for a vane. Unfortunately, the effect of the joint on the stress can be difficult to quantify due to uncertainty in the characteristics of the joint. For example, when the vane and outerband flowpath boundary member are brazed together, the resulting braze geometry (e.g., of the fillet) and braze material properties can be difficult to quantify. If the vane is otherwise highly stressed near the joint, this uncertainty may require that the loading of the vane be decreased such that it operates within acceptable parameters.

To reduce this uncertainty, a platform head is added to the vane. The platform head is offset (or wider and longer) from the vane, thereby moving the location of the joint between the vane 116 and outerband flowpath boundary member 112 away from the vane body 132. The platform head 134, and each portion of the platform head (e.g., 134*a*, 134*b*, and 134*c*) may be dimensioned to have a lateral dimension that is greater than the lateral dimension of the vane 116. The lateral dimension of the vane 116 and platform head 134 is that dimension normal to the length of the vane 116 and substantially parallel to the innerband flowpath boundary surface 122 adjacent to the vane 116. Labeled in FIG. 5 is vane body length 140 to show that dimension. In embodiments in which vane 116 is curved, the vane "length" should be understood to be the mean camber line of the vane 116. The lateral dimensions of the platform head 134 and the body of vane 116 are shown in FIG. 6. As can be seen, the vane body lateral dimension 142 is smaller than the platform head lateral dimension 144. Additionally, the platform head 134 may have a length greater than the body of vane 116 as shown in FIGS. 5 and 6. The greater length and lateral dimensions of the platform head 134 may be referred to as an offset from the vane body 132.

Stress in the vane 116 may also be reduced by introducing a fillet between vane 116 and the outerband flowpath boundary member 112. However, in designs lacking a platform head 134, the fillet must be added between vane 116 and the outerband flowpath boundary member 112 after they have been joined. Adding a consistent, effective fillet directly between the vane 116 and the outerband flowpath boundary member 112 after the two have been joined can be difficult. In embodiments according to the present disclosure, fillet 138 can be added between the platform head 134 and the vane body 132 prior to assembly and the joining of vane 116 to the outerband flowpath boundary member 112. This fillet 138 helps reduce stress on vane 116.

It should be understood that while the vane 116 is depicted as a straight vane of constant or near constant thickness, the present invention is not so limited. For example, vane 116 may be curved and/or may have a changing thickness such that the leading edge of the vane 116 may be thicker than the trailing edge of vane 116, or vice versa. Vane 116 may have its area of maximum thickness at some point between the leading and trailing edges. Regardless of the particular shape of the vane 116, platform head 134 will have a length and lateral dimension greater than the length and lateral dimension of the vane body 132 such that the platform head 134 can effectively move the joint between the vane 116 and the outerband flowpath boundary member 112 away from highly stressed areas of the vane body 132.

The amount of offset between the vane body 132 and the platform head 134 may vary between particular applications. In some embodiments, the offset is equal to the lateral thickness of the fillet 138 (between the vane body 132 and the platform head 134), where the lateral thickness of the fillet 138 is variable in size depending on the particular application and manufacturability of the platform head vane. In some embodiments, the platform head 134 is offset by an amount greater than the lateral thickness of the fillet between the vane body 132 and the platform head 134.

As shown in FIGS. 2 and 3, the innerband casing 104 may be positioned such that the platform head 134 of each vane 116 is received into a respective vane-receiving pocket 110 defined by the outerband flowpath boundary member 112 of the outerband casing 102. The platform head may be inserted such that the fillet 138 is adjacent to the outerband flowpath boundary surface 114. In some embodiments, the fillet 138 may be more distant from the outerband flowpath boundary surface 114 because the platform head 134 may have an offset that is greater than the lateral thickness of the fillet 138. Once received, the platform head 134 and outerband flowpath boundary member 112 may be coupled together by, for example, welding or brazing or other joining technique. Some techniques, for example, brazing, allows the platform head 134 to be joined along its axial thickness (or height) through the thickness of the outerband flowpath boundary member 112. A stronger joint may be formed by increasing the surface area of the joint, for example by allowing the brazing material to cover the wall-thickness of the outerband flowpath boundary member 112 and the corresponding area on the platform head 134.

Figure 7:
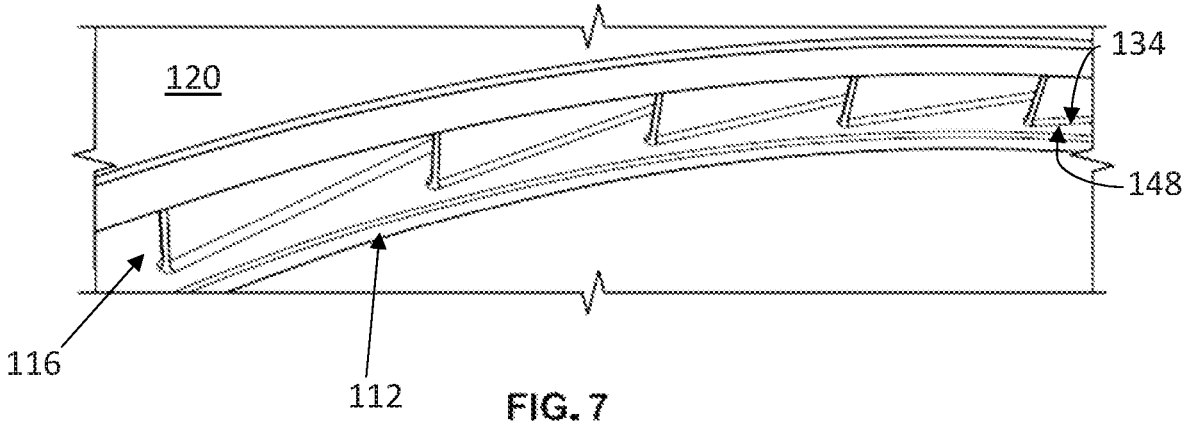
FIG. 7 is a perspective view of a diffuser in accordance with some embodiments of the present disclosure.

FIG. 7 illustrates a perspective view of a diffuser 100 in accordance with some embodiments of the present disclosure. As can be seen in FIG. 7, the platform heads 134 of vanes 116 may been received into the pockets 110 of the outerband flowpath boundary member 112. The braze joint 148 between the platform heads 134 and pockets 110 is then made, as shown, at an offset distance from vane body 132 and/or the fillet 138, depending on the offset of the platform head 134.

In accordance with some embodiments of the present disclosure, a method of diffusing air flow is provided. The method may be performed using the diffuser 100 components as described above. The method may include forming a fluid flowpath defined by a first annular surface, a second annular surface, and a plurality of vanes extending between the first and second annular surfaces. Each of the plurality of vanes may comprise a vane body extending from the first annular surface, and a platform head. The platform head may have lateral dimension (a dimension normal to the length of the vane body parallel to the first and/or second annular surfaces) that is greater than the lateral dimension of the vane body. The platform head of each vane is positioned in a pocket that is defined by the second annular surface. The platform head is joined to the second annular surface by a suitable technique, such as brazing. The method may further comprising supplying an air flow through the fluid flowpath of the diffuser. The supplied air may be from the discharge of a centrifugal compressor.

Although examples are illustrated and described herein, embodiments are nevertheless not limited to the details shown, since various modifications and structural changes may be made therein by those of ordinary skill within the scope and range of equivalents of the claims.

What is claimed is:

1. A diffuser for a centrifugal compressor comprising:

an outerband casing comprising a first flowpath boundary member having a first flowpath boundary surface, said first flowpath boundary member defining a plurality of vane-receiving pockets spaced about a circumference of the member; and an innerband casing comprising a second flowpath boundary member having a second flowpath boundary surface, said second flowpath boundary member comprising a plurality of vanes spaced about a circumference of the member, each of said plurality of vanes comprising a vane body extending from the second flowpath boundary surface, a platform head having a lateral dimension normal to a longitudinal length of the vane body greater than a lateral dimension of the vane body, and a fillet between the platform head and the vane body, said innerband casing being positioned so that the platform head of each of the plurality of vanes is received in a respective vane-receiving pocket defined by the first flowpath boundary member of said outerband casing such that the fillet of each of said plurality of vanes is adjacent the first flowpath boundary surface of the first flowpath boundary member of said outerband casing, wherein said first and second flowpath boundary surfaces of each of said casings and said vanes define a fluid flowpath in said diffuser, wherein each of said vane-receiving pockets comprises a first pocket aperture, a second pocket aperture, and a groove positioned between the first pocket aperture and the second pocket aperture.

2. The diffuser of claim 1, wherein the platform head comprises a first platform portion dimensioned to be positioned in the first pocket aperture, a second platform portion dimensioned to be positioned in the second pocket aperture, and a third platform portion dimensioned to interface with the groove.

3. The diffuser of claim 2, wherein the first platform portion and the second platform portion have an axial dimension that is greater than the axial dimension of the third platform portion.

4. The diffuser of claim 1, further comprising a fillet between the vane body and the second flowpath boundary surface of the second flowpath boundary member of said innerband casing.

5. The diffuser of claim 1, wherein the diffuser is mounted to a static component of the compressor.

6. The diffuser of claim 1, wherein said platform head is brazed to said first flowpath boundary member of said outerband casing.

7. The diffuser of claim 1, wherein the platform head has a length greater than the length of the vane body.

8. The diffuser of claim 1, wherein at least a portion of the platform head has an axial thickness greater than an axial thickness of said first flowpath boundary member of said outerband casing.

9. A diffuser for a centrifugal compressor comprising:

an outerband casing comprising a first flowpath boundary member having a first flowpath boundary surface, said first flowpath boundary member defining a plurality of vane-receiving pockets spaced about a circumference of the member; and an innerband casing comprising a second flowpath boundary member having a second flowpath boundary surface, said second flowpath boundary member comprising a plurality of vanes spaced about a circumference of the member, each of said plurality of vanes comprising a vane body extending from the second flowpath boundary surface, and a platform head having a lateral dimension normal to a length of the vane body greater than a lateral dimension of the vane body, said innerband casing being positioned so that the platform head of each of the plurality of vanes is received in a respective vane-receiving pocket defined by the first flowpath boundary member of said outerband casing, said innerband casing being coupled to said outerband casing by a joint between the platform head of each of the plurality of vanes and the first boundary member of said outerband casing, wherein said first and second flowpath boundary surfaces of each of said casings and said vanes define a fluid flowpath in said diffuser, wherein a portion of each platform head has an axial thickness less than an axial thickness of the first boundary member of said outerband casing and said portion is dimensioned to interface with a groove.

10. The diffuser of claim 9, wherein each platform head is joined to the first boundary member of said outerband casing along the axial thickness of the first boundary member.

11. The diffuser of claim 9, wherein each platform head is joined to the first boundary member of said outerband casing by brazing.

12. The diffuser of claim 9, wherein each of said vane-receiving pockets comprises a first pocket aperture, a second pocket aperture, and the groove positioned between the first pocket aperture and the second pocket aperture.

13. The diffuser of claim 9, wherein each platform head has a length greater than a length of the vane body.

14. A method of diffusing air flow comprising:

forming a fluid flowpath defined by a first annular surface, a second annular surface, and a plurality of vanes extending between the first and second annular surfaces, each of said plurality of vanes comprising a vane body extending from said first annular surface, and a platform head having a lateral dimension normal to the length of the vane body greater than the lateral dimension of the vane body, each platform head being positioned in a pocket defined by the second annular surface and joined to the second annular surface; and supplying air flow through the fluid flowpath;

wherein each of said pockets comprises a first pocket aperture, a second pocket aperture, and a groove positioned between the first pocket aperture and the second pocket aperture.

15. The method of claim 14, further comprising supplying the air flow from a discharge of a centrifugal compressor.

16. The method of claim 14, wherein said platform head of each of said plurality of vanes is joined to the second annular surface by brazing.

* * * * *